US007581969B2

(12) United States Patent
Matsushita

(10) Patent No.: US 7,581,969 B2
(45) Date of Patent: Sep. 1, 2009

(54) CONNECTOR WITH AUXILIARY HOUSING HAVING INVERTED INSERTION PREVENTING PORTION

(75) Inventor: Yasuo Matsushita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/055,555

(22) Filed: Mar. 26, 2008

(65) Prior Publication Data

US 2008/0242158 A1 Oct. 2, 2008

(30) Foreign Application Priority Data

Mar. 28, 2007 (JP) ..... 2007-083229
Nov. 15, 2007 (JP) ..... 2007-296443

(51) Int. Cl.
*H01R 13/44* (2006.01)

(52) U.S. Cl. ..... 439/140; 439/598; 439/903

(58) Field of Classification Search ..... 439/140, 439/141, 595, 598, 701, 752, 680, 903
See application file for complete search history.

(56) References Cited

U.S. PATENT DOCUMENTS 6,176,745 B1 1/2001 Furutani
6,464,522 B2 10/2002 Osawa et al.
6,626,702 B2 * 9/2003 Kurimoto et al. ..... 439/595
6,767,239 B2 7/2004 Fukamachi
6,817,901 B2 * 11/2004 Nishide ..... 439/595
6,827,609 B1 * 12/2004 Martin et al. ..... 439/595
6,896,531 B2 * 5/2005 Bakker et al. ..... 439/140
7,351,102 B2 * 4/2008 Cykon et al. ..... 439/587
7,387,545 B2 * 6/2008 Tyler et al. ..... 439/752

FOREIGN PATENT DOCUMENTS

JP 2003-331929 12/2006

* cited by examiner

*Primary Examiner*—Thanh-Tam T Le
(74) *Attorney, Agent, or Firm*—Gerald E. Hespos; Anthony J. Casella

(57) ABSTRACT

A connector (A) has an auxiliary housing (30) and tabs (91C) project from the front surface of the auxiliary housing (30). A frame (10) has a chamber (13) for the auxiliary housing (30) and a receptacle (12) for surrounding the tabs (91C). A moving plate (60) is mounted into the receptacle (12). Inverted insertion preventing portions (35A, 35B) are formed on outer surfaces of the auxiliary housing (30) and have front ends retracted from the front end of the auxiliary housing (30). The front end of the auxiliary housing (30) can be inserted partly in the accommodating chamber (13) in an inverted posture. However, the inverted insertion preventing portions (35A, 35B) will contact the edge of the chamber (13) while the front ends of tabs (91C) and the rear end of the moving plate (60) are distanced from each other.

11 Claims, 12 Drawing Sheets

FBD

CONNECTOR WITH AUXILIARY HOUSING HAVING INVERTED INSERTION PREVENTING PORTION

BACKGROUND OF THE INVENTION

1. Field of the Invention

The present invention relates to a connector.

2. Description of the Related Art

U.S. Pat. No. 6,176,745 discloses a connector with an auxiliary housing and male tabs that project in an exposed manner from the front surface of the connector. The connector also includes receptacle with an accommodating chamber for the auxiliary housing and a receptacle for surrounding the male tabs.

Japanese Unexamined Patent Publication No. 2006-331929 discloses a connector that has a housing formed with a receptacle. A moving plate is mounted in the receptacle and is movable back and forth between a position before the front surface of the housing and a position closer to the front surface of the housing. Male tabs project from the front surface of the housing and pass through the moving plate.

The auxiliary housing of U.S. Pat. No. 6,176,745 can be inverted from a proper posture for insertion into the accommodating chamber of the frame, and there is a possibility that the auxiliary housing is forced into the accommodating chamber by pushing the walls of the receptacle outwardly. A connecting operation with a mating female housing then might be started with the auxiliary housing mounted erroneously.

An inverted insertion preventing portion has been considered for the outer surface of the auxiliary housing to interfere with the rear opening edge of the accommodating chamber when the auxiliary housing is inverted. The male tabs are exposed at a front of the connector in U.S. Pat. No. 6,176,745. Thus, the leading ends of the male tabs could interfere with the moving plate of Japanese Unexamined Patent Publication No. 2006-331929 if the auxiliary housing is in the inverted posture, even with the inverted insertion preventing portion on the outer surface of the auxiliary housing. As a result the tabs or the moving plate could be damaged.

U.S. Pat. No. 6,767,239 discloses a connector with an auxiliary housing assembled in a main housing. Tab-shaped terminals are accommodated in the auxiliary housing and project in an exposed manner from the front surface of the auxiliary housing when the auxiliary housing is alone. However, the tabs are covered in a protected manner in a receptacle of the main housing when the auxiliary housing is assembled into the main housing.

U.S. Pat. No. 6,464,522 discloses another connector with a receptacle and tabs that project into the receptacle. A moving plate is mounted in the receptacle and leading ends of the tabs project through the moving plate to position and align portions of the tabs projecting into the receptacle.

A moving plate, as disclosed in U.S. Pat. No. 6,464,522, is required in the receptacle of U.S. Pat. No. 6,767,239 if importance is attached to positioning and protecting the tabs in the connector. The moving plate of U.S. Pat. No. 6,464,522 could be applied to the connector of U.S. Pat. No. 6,767,239, and the leading ends of the tabs will pass through the moving plate if the auxiliary housing is in a proper assembling posture. However, the leading ends of the exposed tabs could contact the rear surface of the moving plate and could be bent if the auxiliary housing is inverted.

The invention was developed in view of the above situation and an object thereof is to provide a connector that prevents an erroneous assembly of an auxiliary housing and that prevents the leading ends of male tabs from being broken when the auxiliary housing is assembled into a frame.

SUMMARY OF THE INVENTION

The invention relates to a connector with at least one auxiliary housing and one or more terminal fittings projecting in an exposed manner from a front portion of the auxiliary housing. The connector also has at least one chamber for the auxiliary housing and a receptacle for at least partly surrounding the terminal fittings. A moving plate is mounted in the receptacle and is movable back and forth between a position before the front surface of the auxiliary housing and a position closer to the front surface of the auxiliary housing while the terminal fittings are passed therethrough. At least one inverted insertion preventing portion is formed on the auxiliary housing for contacting the rear opening edge of the chamber if the auxiliary housing is inserted into the chamber in an improper posture. The front end of the inverted insertion preventing portion is retracted from the front end of the auxiliary housing, and the front ends of the terminal fittings and the rear end of the moving plate are distanced from each other when the inverted insertion preventing portion contacts the rear opening edge of the chamber with the front end of the auxiliary housing fit partly in the chamber. Thus, the inverted insertion preventing portion is guided reliably to this contact position, and the auxiliary housing cannot be accommodated forcibly into the chamber. In this case, the front ends of the terminals and the rear end of the moving plate are distanced from each other so that the exposed terminals cannot be broken by interference with the moving plate.

The chamber preferably has at least one front-stop that contacts the inverted insertion preventing portion when the auxiliary housing is inserted into the chamber in the proper inserting posture to prevent any further forward movement of the auxiliary housing. Thus, a front space of the auxiliary housing can be utilized efficiently, as compared to a case where the front surface of the auxiliary housing is used to prevent the auxiliary housing from moving any further forward and where a front-stop means for the auxiliary housing is provided separately.

At least one terminal fitting that is larger than the other terminal fittings may project into the receptacle. Smaller terminal fittings are broken more easily by impact. Accordingly, the moving plate preferably is mounted into a part of the receptacle corresponding to the auxiliary housing and allows the smaller terminal fittings mounted in the auxiliary housing to be passed therethrough. Thus, the smaller terminal fittings are protected by the moving plate to prevent breakage. The larger terminal fittings are less likely to be broken by impact, and therefore need not be protected by the moving plate. Thus, the moving plate can be made smaller and can have a lower cost.

The connector preferably has a housing main body and the chamber penetrates the housing main body in forward and backward directions. The auxiliary housing can be inserted into the chamber of the housing main body. The receptacle projects forward from the housing main body so that portions of the terminals are in the receptacle. One of the auxiliary housing and the housing main body includes at least one rib and the other includes at least one receiving groove. The rib conforms to the receiving groove if the auxiliary housing is in a proper inserting posture so that the auxiliary housing can be inserted into the housing main body. However, the rib does not conform to the receiving groove if the auxiliary housing is in an improper posture, and hence the rib interferes with a wall surface offset from the groove to prevent insertion of the auxiliary housing into the housing main body. The leading ends of the terminals accommodated in the auxiliary housing are distanced back from the surface of the moving plate when the rib contacts the wall surface offset from the groove. Thus, the leading ends of the terminals will not be bent or otherwise damaged by interference with moving plate.

The auxiliary housing preferably is inserted into the chamber of the housing main body from behind and is capable of accommodating terminals with tabs that project forward in an exposed state from the auxiliary housing when the auxiliary housing is alone.

The receptacle preferably is a tube that projects forward from the housing main body, and the tabs of the terminals are arranged in the tube when the auxiliary housing is in the chamber. The moving plate is mounted into the tubular receptacle for aligning the tabs and allowing the tabs to pass therethrough.

The at least one receiving groove preferably is formed in the inner surface of the chamber of the housing main body, and the at least one rib preferably is provided on the outer peripheral surface of the auxiliary housing.

The front end of the at least one rib preferably is retracted from the front surface of the auxiliary housing.

An area of the auxiliary housing before the front end of the rib preferably is fit into the chamber when the rib interferes with the surface of the housing main body if the auxiliary housing is in the improper posture. Therefore, the rib of the auxiliary housing cannot be inserted forcibly into the chamber and reliability in preventing the erroneous assembling is improved.

The front end of the receiving groove preferably serves as a front-stop for contacting the rib to prevent the auxiliary housing from moving any farther forward when the auxiliary housing reaches a proper assembled position. Thus, the construction of the housing main body can be simplified as compared to the case where the front-stop is provided separately.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with a first embodiment of the invention is identified by the letter A in FIGS. 1 to 5. The connector A of this embodiment is provided with a frame 10, an auxiliary housing 30, a moving plate 60 and male terminal fittings 90A, 90B and 90C of different kinds. A connecting end with a mating connector (not shown) is referred to as the front.

Figure 2:
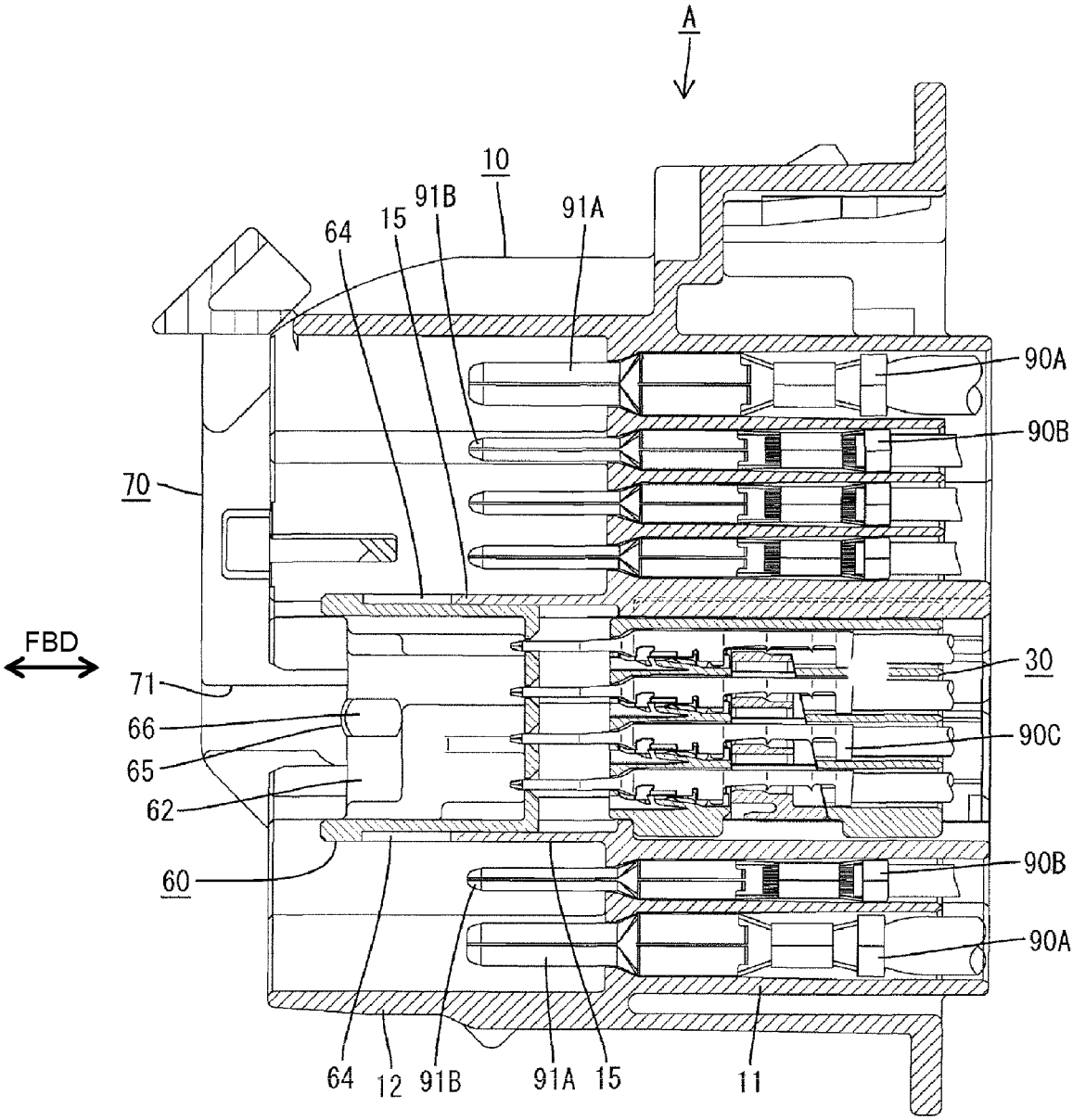
FIG. 2 is a side view in section of the connector of FIG. 1.
Figure 4:
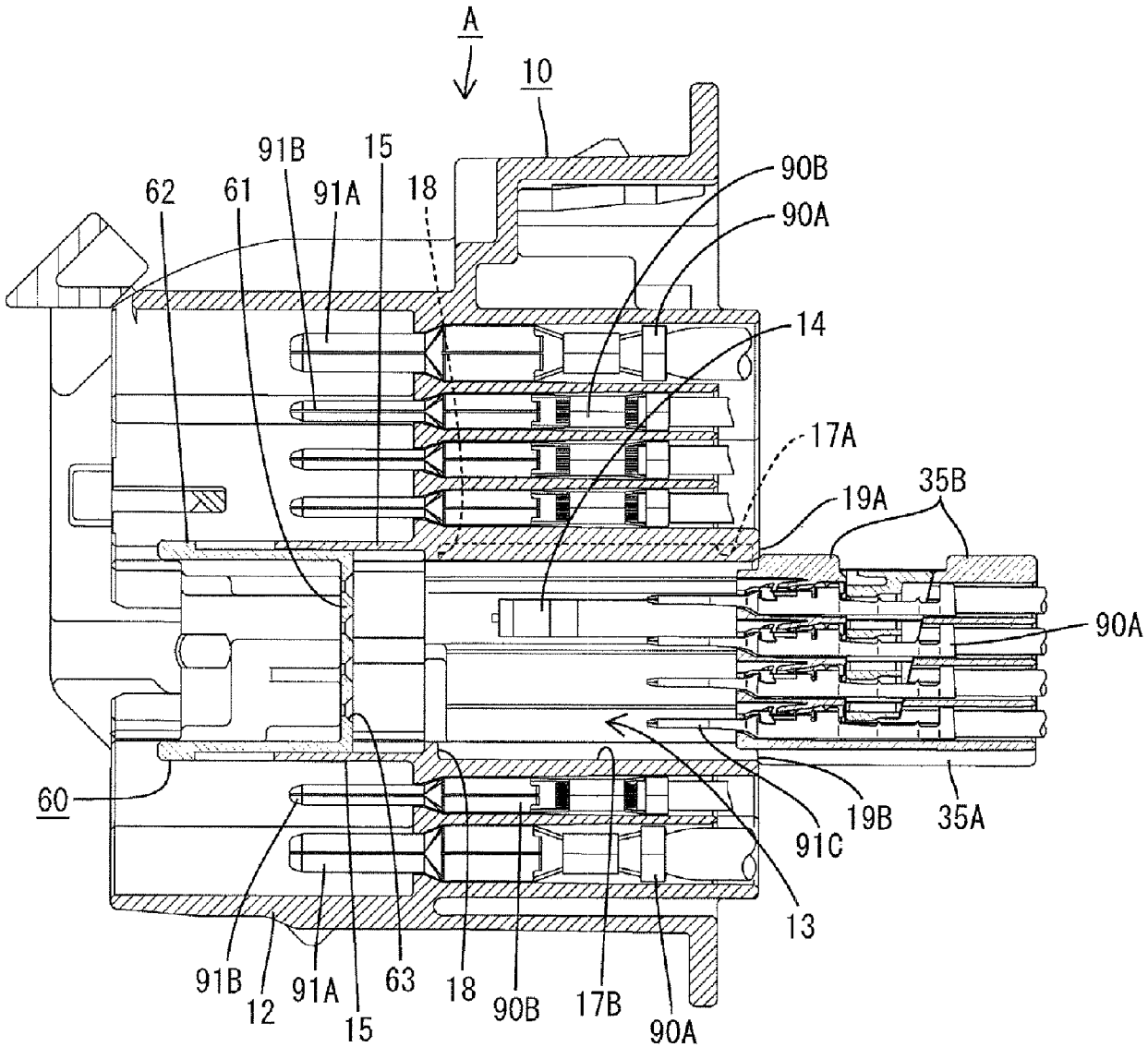
FIG. 4 is a side view in section showing a state where inverted insertion preventing portions are in contact with contact portions when the auxiliary housing is in an inverted posture.

The frame 10 is made e.g. of a synthetic resin and, as shown in FIG. 2, includes a substantially block-shaped housing 11 and a substantially tubular receptacle 12 projecting unitarily forward from the front surface of the housing 11. As shown in FIG. 4, a chamber 13 penetrates a substantially vertical middle part of the housing 11 in forward and backward directions FBD and the auxiliary housing 30 can be inserted into the 13 from behind. Left and right locking pieces 14 are formed at substantially opposite inner side surfaces of the chamber 13 at positions close to the ceiling surface. The locking pieces 14 engage the auxiliary housing 30 to prevent the auxiliary housing 30 from coming out of the chamber 13.

Different types of male terminal fittings 90A, 90B and 90C having different sizes and shapes are held in the housing 11 including the auxiliary housing 30 so as not to come out e.g. backward. Long narrow male tabs 91A, 91B and 91C are formed at the front ends of the respective male terminal fittings 90A, 90B and 90C, and project into the receptacle 12 to be surrounded by the receptacle 12. The first male tabs 91A are the largest and are arranged at uppermost and bottommost positions. The third male tabs 91C are the smallest and are arranged in a vertical middle part of the housing 11 in the auxiliary housing 30. The second male tabs 91B have an intermediate size and are arranged between the two types of male tabs 91A, 91C. The projecting distance of the male tabs 91A from the front surface of the housing part 11 is substantially equal to the projecting distance of the second male tabs 91B. However, the projecting distance of the third male tabs 91C is shorter than the projecting distances of the first and second male tabs 91A, 91B.

Upper and lower partition plates 15 projecting forward in the receptacle 12 at upper and lower sides of the opening edge of the chamber 13. The partition plates 15 are substantially parallel and are near the upper and lower sides of a projection space for the third male tabs 91C. Thus, the two partition plates 15 partition the first and second male tabs 91A, 91B and the third male tabs 91C. The moving plate 60 is engaged movably with the partition plates 15.

Figure 3:
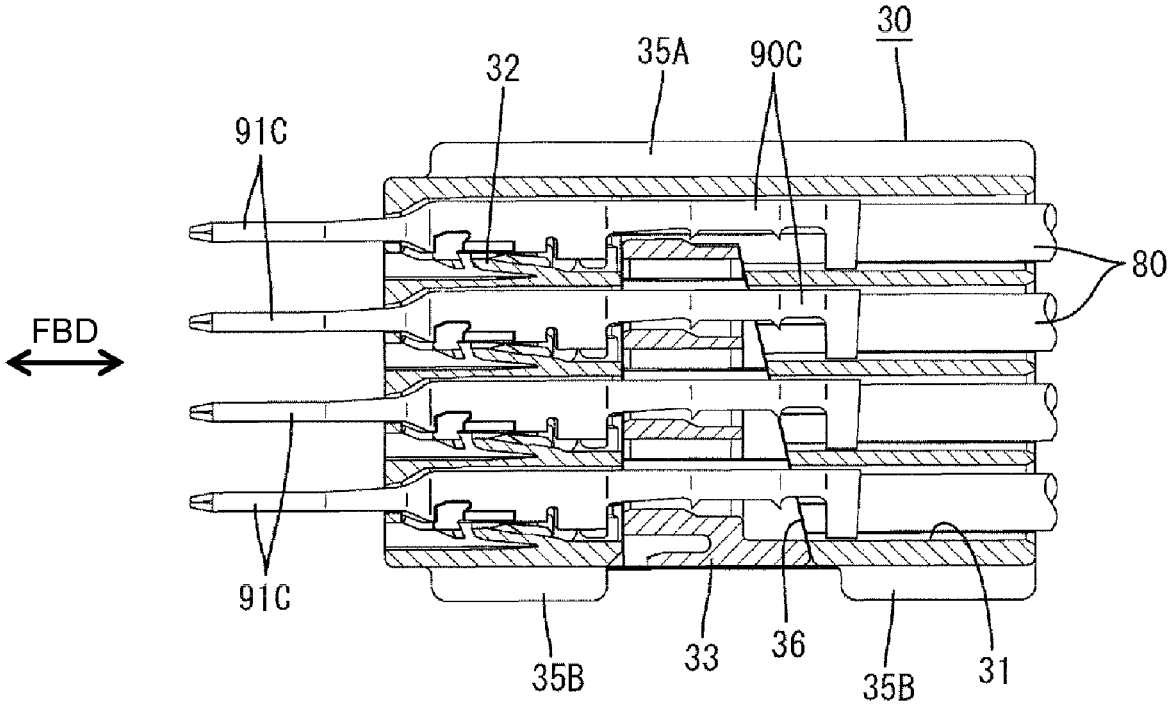
FIG. 3 is a side view in section of an auxiliary housing having male terminal fittings mounted therein.
Figure 5:
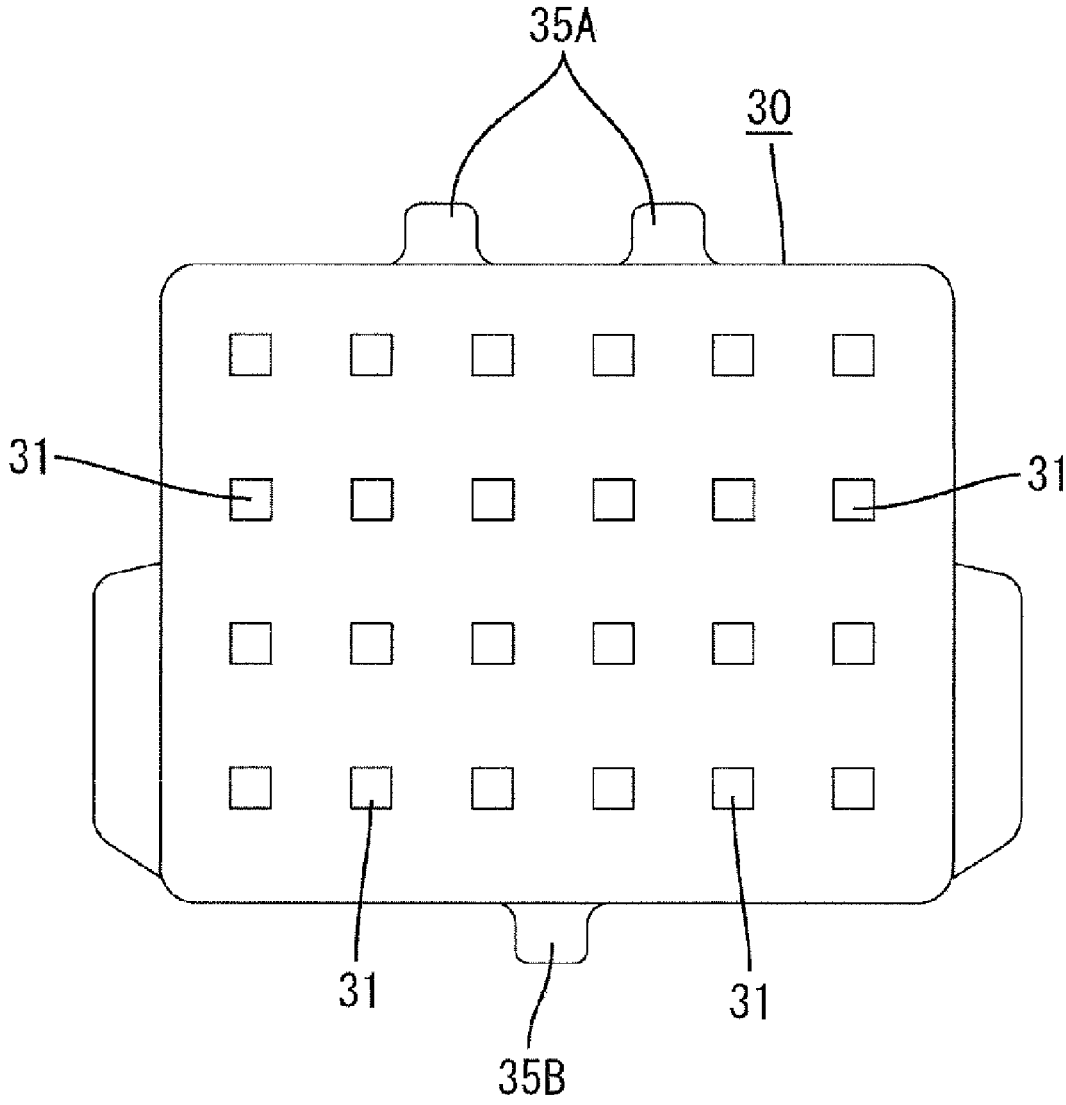
FIG. 5 is a front view of the auxiliary housing.
Figure 6:
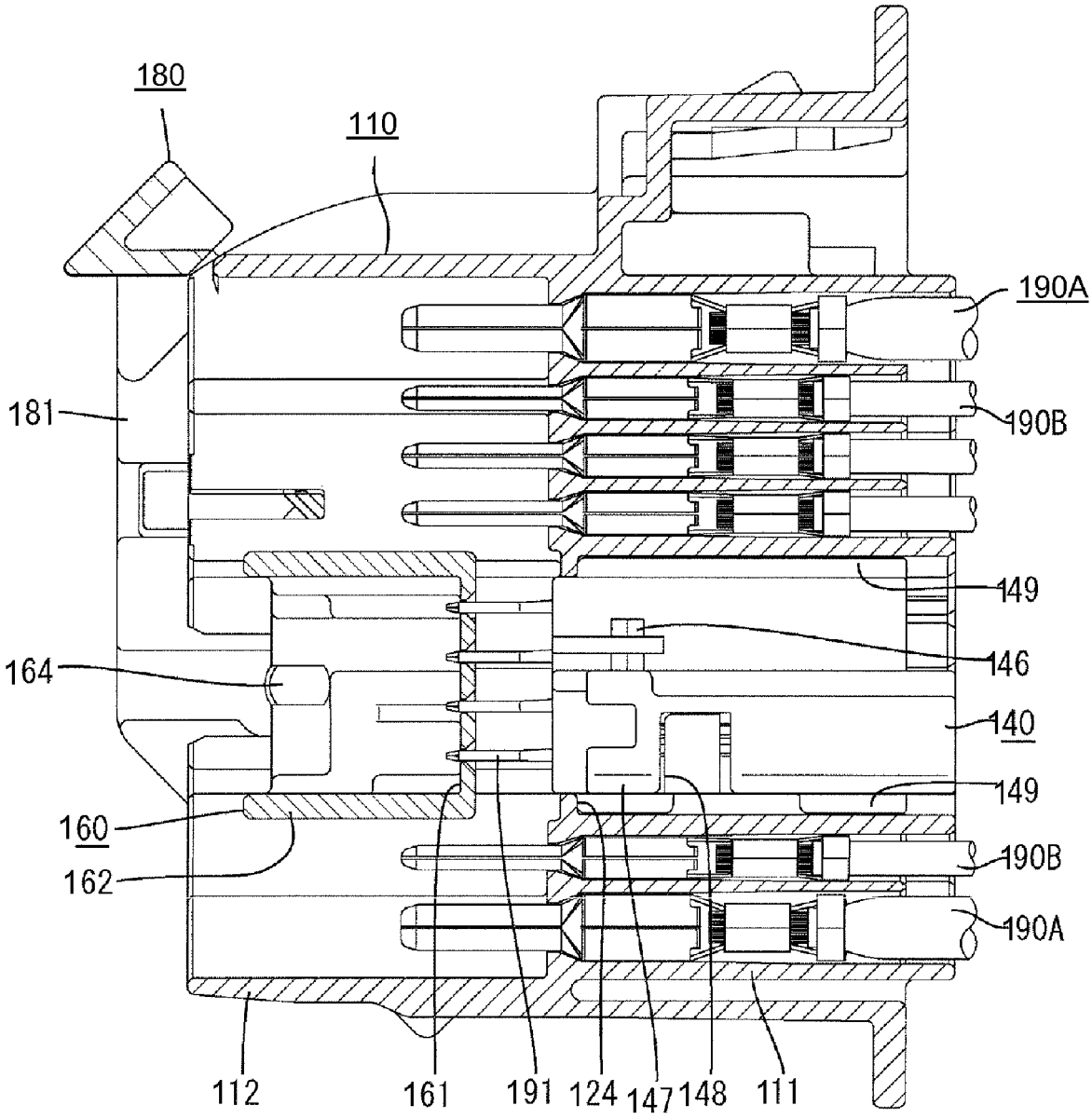
FIG. 6 is a side view in section of a connector according to second embodiment.

The auxiliary housing 30 is made e.g. of a synthetic resin to define a rectangular block with cavities 31C. The third male terminal fittings 90C connected with ends of wires 80 are inserted into the cavities 31C from behind, as shown in FIGS. 3 and 5. The third male terminal fittings 90C properly inserted into the respective cavities 31 are locked primarily by resiliently deformable locks 32 on the inner walls of the cavities 31 and are locked secondarily by a retainer 33 that penetrates the upper and lower cavities 31 to retain the third male terminal fittings 90C in the cavities 31. The third male tabs 91C project forward in an exposed manner from the front surface of the auxiliary housing 30.

Inverted insertion preventing ribs 35A, 35B project from the outer surfaces of the auxiliary housing 30 for preventing an erroneous assembling of the auxiliary housing 30 into the frame 10. More particularly, left and right inverted insertion preventing ribs 35A are arranged near opposite widthwise sides of the top surface of the auxiliary housing 30, and an insertion preventing rib 35B is arranged at a position that is substantially in the widthwise center of the bottom surface of the auxiliary housing 30. The left and right inverted insertion preventing portions 35A on the top surface are closer to the locking pieces 14 with the frame 10 as compared to the inverted insertion preventing ribs 35B on the bottom surface. The front and rear end positions of the inverted insertion preventing ribs 35A, 35B are aligned substantially. Front ends of the inverted insertion preventing ribs 35A, 35B are more backward than the front end of the auxiliary housing 30 and the rear ends are at the same positions as the rear end of the auxiliary housing 30. The left and right inverted insertion preventing portions 35*a* on the top surface are at substantially the same height over the entire lengths in forward and backward directions FBD. The inverted insertion preventing portion 35B on the bottom surface is divided into front and rear parts at opposite sides of an insertion hole 36 for the retainer 33. The front and rear parts are at substantially the same height in forward and backward directions FBD. A part of the auxiliary housing 30 before the inverted insertion preventing portions 35A, 35B conforms to the rear opening edge of the chamber 13.

Figure 1:
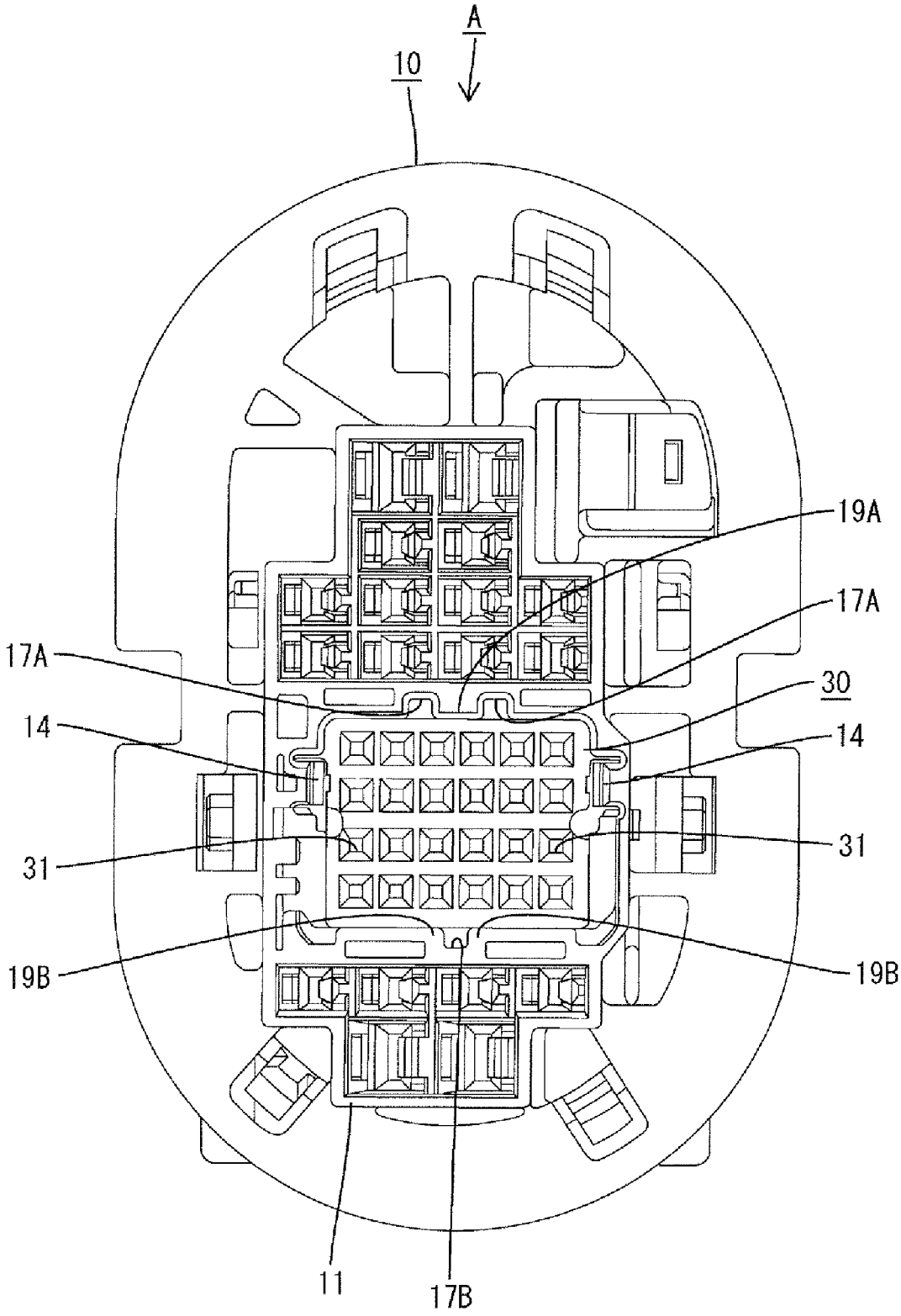
FIG. 1 is a rear view of a connector according to a first embodiment.

Receiving grooves 17A, 17B are formed in the chamber 13 of the frame 10, as shown in FIG. 1, and are at positions corresponding to the inverted insertion preventing ribs 35A, 35B if the auxiliary housing 30 is in a proper assembling posture. Specifically, left and right receiving grooves 17A are formed in the ceiling of the chamber 13, and a receiving groove 17B is formed in the bottom wall of the chamber 13. The receiving grooves 17A, 17B extend in forward and backward directions FBD and open in the rear edge of the chamber 13. The receiving grooves 17A, 17B terminate at front stops 18 adjacent the front opening end of the chamber 13 for preventing further forward movement when the auxiliary housing 30 has reached a proper assembled position. A contact 19A is between the left and right receiving grooves 17A at the upper side of the rear-end opening edge of the chamber 13 and contacts 19B are at the opposite sides of the one receiving groove 17B in an intermediate position of the bottom of the rear opening edge of the chamber 13. The contacts 19A and 19B contact the respective inverted insertion preventing portions 35A, 35B when the auxiliary housing 30 is in an improper posture.

The moving plate 60 is made unitarily e.g. of a synthetic resin, and defines a substantially cap-shape. More particularly, the moving plate 60 has a substantially wide rectangular planar main portion 61 aligned substantially at right angles to the projecting direction of the male tabs 91A, 91B and 91C. A rectangular tubular surrounding wall 62 projects forward from the peripheral edge of the main portion 61 over substantially the entire periphery. A vertical dimension of the moving plate 60 is less than the vertical dimension of the opening of the receptacle 12 and a transverse dimension of the moving plate 60 is equal to or slightly smaller than the transverse dimension of the opening of the receptacle 12. The moving plate 60 is arranged only at a position corresponding to the chamber 13 to protect the third male tabs 91C, and the first and second male tabs 91A, 91B are arranged in areas above and below the moving plate 60.

Positioning holes 63 penetrate the main portion 61 substantially in forward and backward directions FBD, and are disposed so that the respective third male tabs 91C can be passed through and positioned by the positioning holes 63. The surrounding wall 62 has substantially planar upper and lower walls and engaging grooves 64 are formed in the upper and lower walls for receiving the partition plates 15. The moving plate 60 is movable in forward and backward directions FBD along the partition plates 15 between an advanced position and a retracted position. The main portion 61 is distanced forward from the front surface of the auxiliary housing 30 and near the opening of the receptacle 12 and the leading ends of the third male tabs 91C are passed through the positioning holes 63 when the moving plate 60 is at the advanced position and. On the other hand, the rear surface of the main portion 61 is substantially in contact with the front surface of the auxiliary housing 30 and the third male tabs 91C are passed through the positioning holes 63 and project forward from the front surface of the main portion 61 at the retracted position.

Cam followers 65 project from the outer side surfaces of the opposite side walls of the surrounding wall 62. Each cam follower 65 has a recess 66 with an open front, and a corresponding cam pin of a mating female connector (not shown) can be inserted into the recess 66. A lever 70 is mounted rotatably on the opposite outer side surfaces of the receptacle 12, and the cam followers 65 are engageable with cam grooves 71 of the lever 70 through the opposite side walls of the receptacle 12. The mutual engagement of the cam followers 65 and the cam grooves 71 generates a cam action as the lever 70 is rotated and moves the moving plate 60 in forward and backward directions FBD between the advanced position and the retracted position. Specifically, the moving plate 60 is at the advanced position when the lever 70 is at the initial position. The moving plate 60 moves towards the back of the receptacle 12 and the partition plates 15 are inserted into the engaging grooves 64 as the lever 70 is rotated towards a connection position. The moving plate 60 is at the retracted position when the lever 70 reaches the connection position.

Initially, the lever 70 is held at the initial position, the moving plate 60 is held at the advanced position and the first and second male terminal fittings 90A, 90B are mounted into the housing part 11 so that the first and second male tabs 91A, 91B to project into the receptacle 12. On the other hand, the third male terminal fittings 90C are accommodated in the cavities 31 of the auxiliary housing 30 so that the third male tabs 91C project in an exposed manner from the front surface of the auxiliary housing 30.

The auxiliary housing 30 then is inserted into the accommodating chamber 13 of the frame 10 from behind. The left and right inverted insertion preventing ribs 35A are at the upper side and the inverted insertion preventing rib 35B is at the lower side if the auxiliary housing 30 is in a proper inserting posture. Thus, the respective inverted insertion preventing ribs 35A, 35B conform to the corresponding receiving grooves 17A, 17B of the frame 10 and the auxiliary housing 30 moves substantially horizontally in the chamber 13 while the inverted insertion preventing ribs 35A, 35B slide on the surfaces of the receiving grooves 17A, 17B. The locking pieces 14 prevent the auxiliary housing 30 from coming out of the chamber 13 when the auxiliary housing 30 reaches a proper assembling position, the auxiliary housing 30 and the respective inverted insertion preventing ribs 35A, 35B contact the corresponding front-stops 18 to prevent further forward movement of the auxiliary housing 30 (see FIG. 2). In this way, the auxiliary housing 30 is held in the chamber 13 of the frame 10 so as not to make movements. At this time, the front end of the auxiliary housing 30 is at substantially the same position as the front end of the housing part 11 (back end of the receptacle 12) in forward and backward directions FBD, and the rear end of the auxiliary housing 30 is more forward than the rear end of the frame 10 to enter the chamber 13.

With the auxiliary housing 30 properly assembled into the frame 10 in this way, the front ends of the third male tabs 91C are exposed at the front of the main portion 61 by passing through the corresponding positioning holes 63 of the moving plate 60. In this state, the mating female connector is fit lightly into the receptacle 12 and the lever 70 is rotated towards the connection position to perform or assist the connection with the female connector. The female connector is fit deeply into the receptacle 12 when the lever 70 reaches the connection position and the moving plate 60 reaches the retracted position. Thus, all of the male tabs 91A, 91B and 91C, including the third male tabs 91C, are connected electrically to proper depths with the corresponding female terminal fittings.

The auxiliary housing 30 could erroneously be in an inverted posture with the left and right inverted insertion preventing ribs 35A at the lower side and the inverted insertion preventing rib 35B at the upper side. In this situation, front portions of the auxiliary housing 30 located before the inverted insertion preventing ribs 35A, 35B will enter the chamber 13 through the rear-end opening and will be guided by the inner wall of the chamber 13 so that the top and bottom surfaces of the auxiliary housing 30 are substantially horizontal. Thus, the inverted insertion preventing ribs 35A, 35B come to be located right behind the contacts 19A, 19B. Further forward movement of the inverted auxiliary housing 30 will urge the one inverted insertion preventing rib 35B against the contact 19A between the left and right receiving grooves 17A at the upper side and will urge the left and right inverted insertion preventing ribs 35A against the contacts 19B at the opposite sides of the one receiving groove 17B at the lower side to prevent any further forward movement of the auxiliary housing 30 (see FIG. 4). At this time, the front ends of the third male tabs 91C projecting from the front surface of the auxiliary housing 30 are in the chamber 13 rearward of the moving plate 60 (main portion 61). Therefore the third male tabs 91C and the moving plate 60 are kept away from each other. The contact feeling of the inverted insertion preventing ribs 35A, 35B against the contacts 19A, 19B clearly indicates that the auxiliary housing 30 is in the inverted posture. Thus, the auxiliary housing 30 is pulled out from the chamber 13, corrected to the proper inserting posture and inserted into the chamber 13.

As described above, if the front end of the auxiliary housing 30 is inserted partly into the chamber 13 of the frame 10 in the inverted posture, the inserting posture of the auxiliary housing 30 is restrained circumferentially by the inner wall of the chamber 13 and the inverted insertion preventing ribs 35A, 35B are guided to positions corresponding to the contacts 19A, 19B. Thus, there is no likelihood that the auxiliary housing 30 in the inverted posture is inserted forcibly into the chamber 13. With the inverted insertion preventing ribs 35A, 35B held in contact with the contacts 19A, 19B in this way, the front ends of the third male tabs 91C and the rear end of the moving plate 60 are distanced from each other to prevent the exposed third male tabs 91C from being broken due to interference with the moving plate 60.

If the auxiliary housing 30 is inserted into the chamber 13 in the proper inserting posture, the inverted insertion preventing ribs 35A, 35B contact the front-stops 18 to prevent further forward insertion of the auxiliary housing 30. Thus, as compared to the case where the front surface of the auxiliary housing 30 is used to prevent the auxiliary housing 30 from moving any further forward, a front space of the auxiliary housing 30 can be utilized effectively and, in addition, the construction of the auxiliary housing 30 can be simplified as compared to the case where the front-stop means for the auxiliary housing 30 is provided separately as a special structure.

The third male tabs 91C are smaller than the other first and second male tabs 91A and 91B, and hence are broken more easily by an impact. However, the third male tabs 91C are protected by the moving plate 60 to prevent breakage. There is little need to protect the larger first and second male tabs 91A and 91B. Thus, no moving plate 60 is provided through which the first and second male tabs 91A and 91B can move. As a result, the moving plate 60 is made smaller, has a lower cost and can be managed more easily.

A second embodiment of the invention is described with reference to FIGS. 6 to 12. A connector of this embodiment is a male connector provided with a housing 110, at least one auxiliary housing 140, a moving plate 160, a lever 180 and terminals 190. The terminals 190 are made of a metal and the other parts are made e.g. of a synthetic resin.

The housing 110 includes a housing main body 111 in the form of a vertically long block and a vertically long tubular receptacle 112 projects unitarily forward from the outer periphery of the front surface of the housing main body 111. Escaping grooves 113 in the form of slits extend back from the front end of the receptacle 112. The escaping grooves 113 are formed in the opposite side walls of the receptacle 112 and substantially face each other in the width direction.

The terminals 190 include large tabs 190A arranged at uppermost and bottommost positions of the receptacle 112, and small tabs 191 corresponding to the auxiliary housing 140 are arranged in a substantially vertical middle part. Further, intermediate size tabs 190B are arranged between the large and small tabs 190A, 191. Projecting distances of the large and intermediate size tabs 190A are substantially equal, but the small tabs 191 have a shorter projecting distance.

Figure 7:
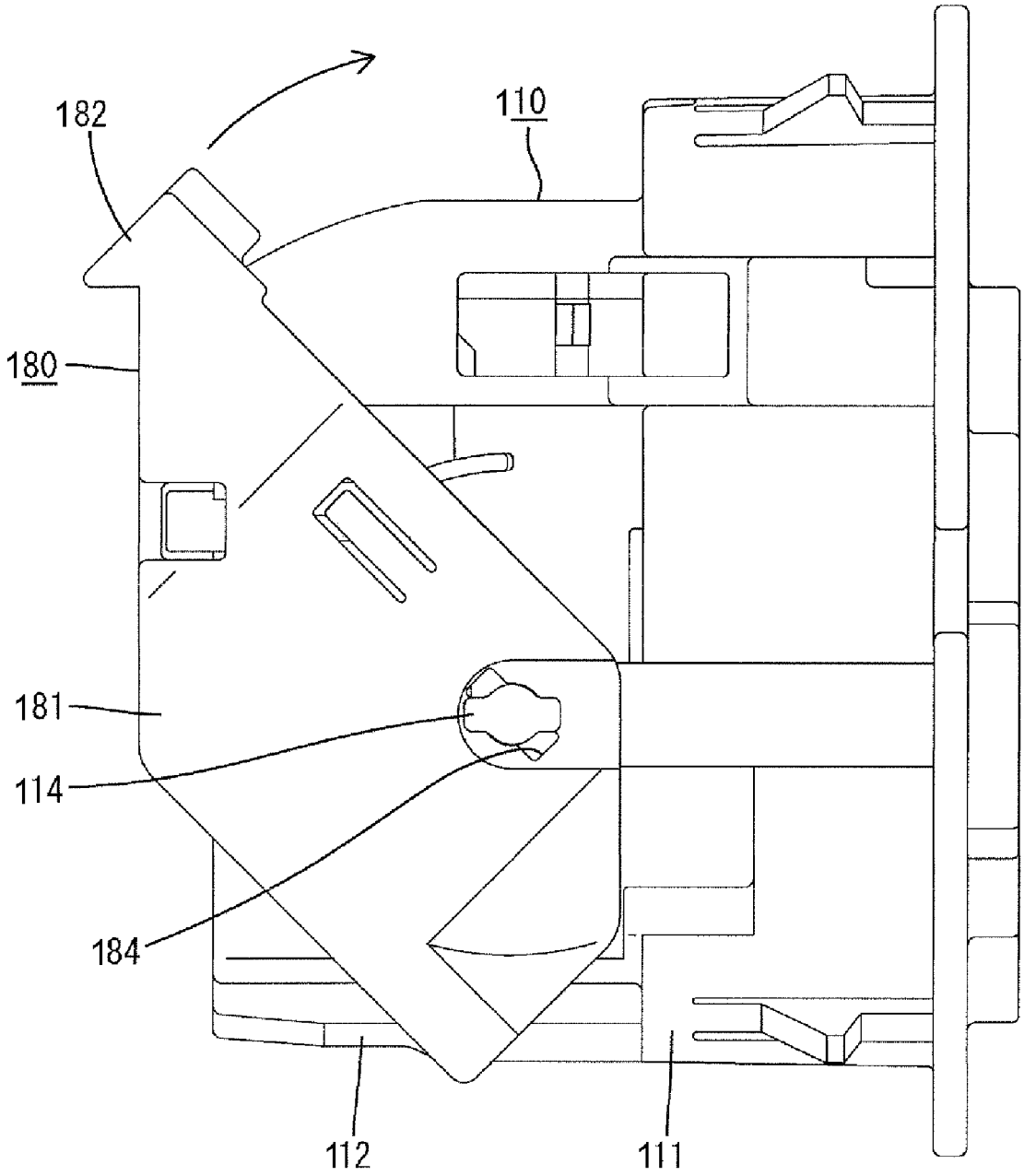
FIG. 7 is a side view of the connector of FIG. 6.

As shown in FIG. 7, the lever 180 is formed unitarily to include two plate-like arms 181 and an operable portion 182 that connects the upper or distal ends of the arms 181. The arms 181 extend along the outer surfaces of the opposite side walls of the receptacle 112. Each arm 181 is formed with a cam groove 183 and a bearing hole 184 that is mounted on a corresponding supporting shaft 114 projecting from the outer surface of the receptacle 112. Thus, the lever 180 is rotatable about the supporting shafts 114 in a direction of arrow in FIG. 7 from an initial position where the entrances of the cam grooves 183 align with the escaping grooves 113 of the receptacle 112 to a connection position where a mating female connector (not shown) is connected to a proper depth.

Figure 9:
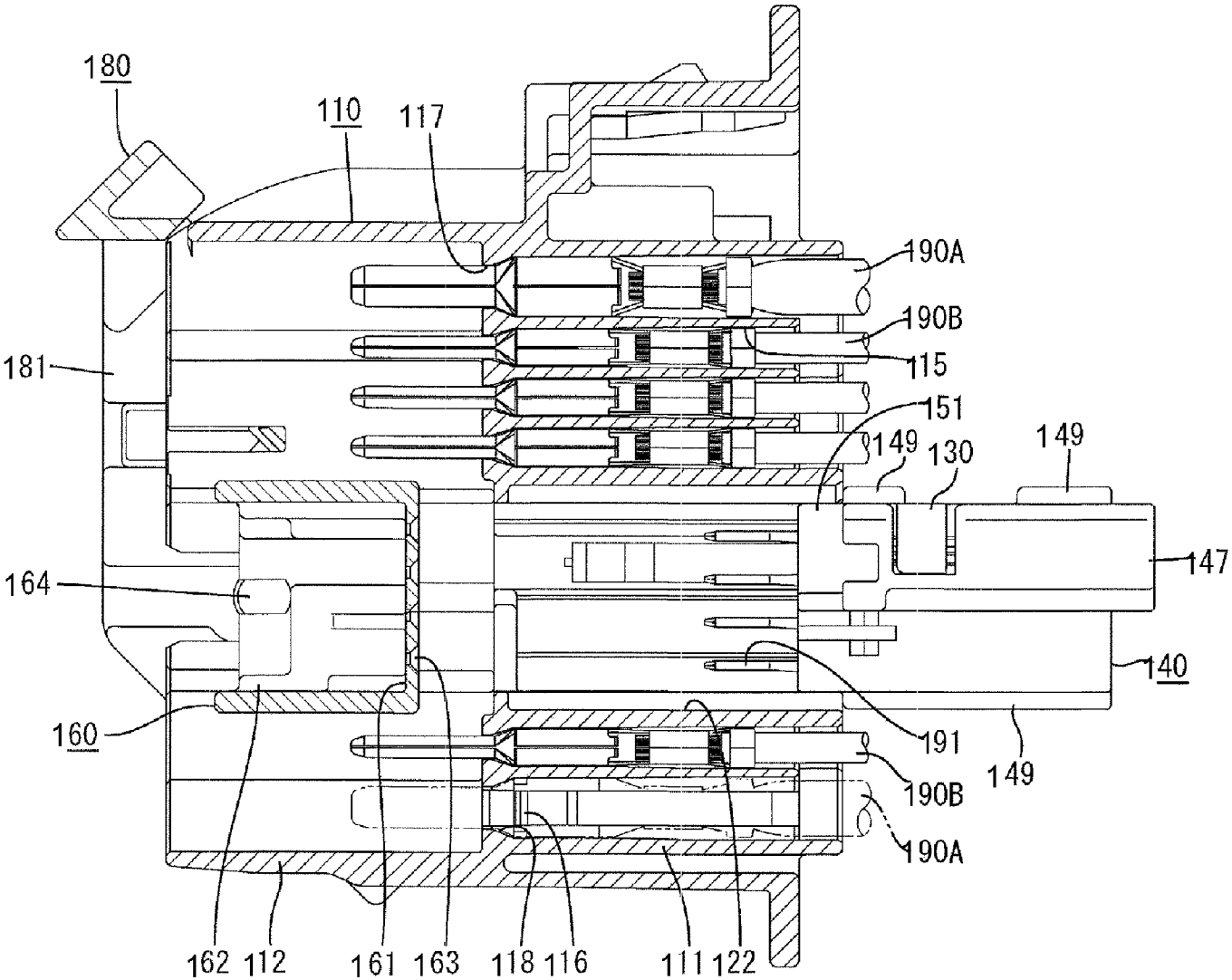
FIG. 9 is a side view in section showing a state where the auxiliary housing is in an inverted posture and ribs interfere with a housing main body.

As shown in FIG. 9, the moving plate 160 includes a substantially planar main body 161 aligned substantially parallel to the front surface of the housing main body 111 and a long rectangular tube 162 projecting forward from the peripheral edge of the plate main body 161. This moving plate 160 is inserted into the receptacle 112 to be arranged in an intermediate part of the receptacle 112 in the height direction. The upper surface of the moving plate 160 is distanced from the lower surface of the upper wall of the receptacle 112 and the lower surface of the moving plate is distanced from the upper surface of the bottom lateral wall of the receptacle 112. Positioning holes 163 penetrate the main body 161. Left and right cam followers 164 project from the opposite side walls of the tube 162 and face each other in the width direction. The two cam followers 164 can be fit into the cam grooves 183 of the lever 180 through the respective escaping grooves 113 of the receptacle 112 in width direction, and cam pins (not shown) of the mating female connector can be fit into the cam followers 164. Cam action is exhibited by the engagement of the cam followers 164 and the cam grooves 183 through the rotation of the lever 180, and the moving plate 160 is movable in forward and backward directions FBD in the receptacle 112 as the lever 180 is rotated. More specifically, the moving plate 160 is at an advanced position near the opening of the receptacle 112 when the lever 180 is at the initial position; moves towards the back side of the receptacle 112 as the lever 180 is rotated towards the connection position; and comes to a retracted position where the plate main body 161 has the front surface thereof held in contact with the mating female housing and the rear surface thereof held in contact with the auxiliary housing 140 when the lever 180 reaches the connection position. At the advanced position, the leading ends of the tabs 191 (to be described later) of the terminals 190 in the auxiliary housing 140 pass through the positioning holes 163 of the plate main body 161 to be surrounded by the tube 162. As the moving plate 160 moves towards the retracted position, the tabs 191 are inserted farther into the tube 162.

Cavities 115 for accommodating the terminals 190 are formed substantially side by side in an upper area and a lower area of the housing main body 111. The terminals 190 are inserted into the cavities 115 from behind, and resiliently deformable locks 116 are formed on the inner walls of the cavities 115 for preventing the terminals 190 from coming out or moving backward. Insertion holes 117 for the tabs 191 of the terminals 190 are formed in the front walls of the cavities 115 and slanted front-stop surfaces 118 are located at least partly around the insertion hoes 117 for preventing any further forward movements of the tab-shaped terminals 190. The tabs 191 of the respective terminals 190 inserted into the cavities 115 project into the receptacle 112 with the leading ends thereof aligned.

Figure 8:
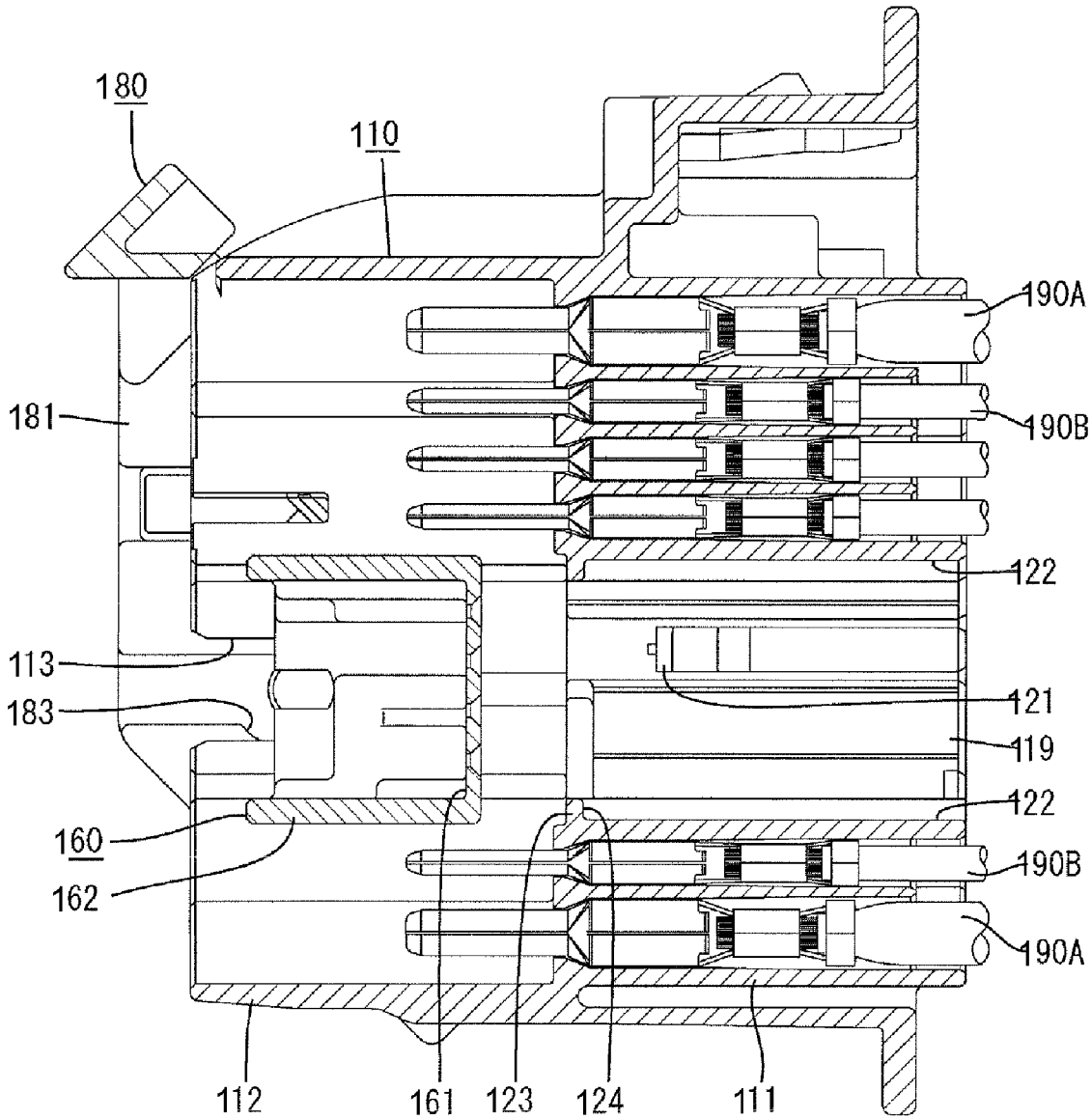
FIG. 8 is a side view in section of the connector of FIG. 6 showing a state before an auxiliary housing is inserted.
Figure 10:
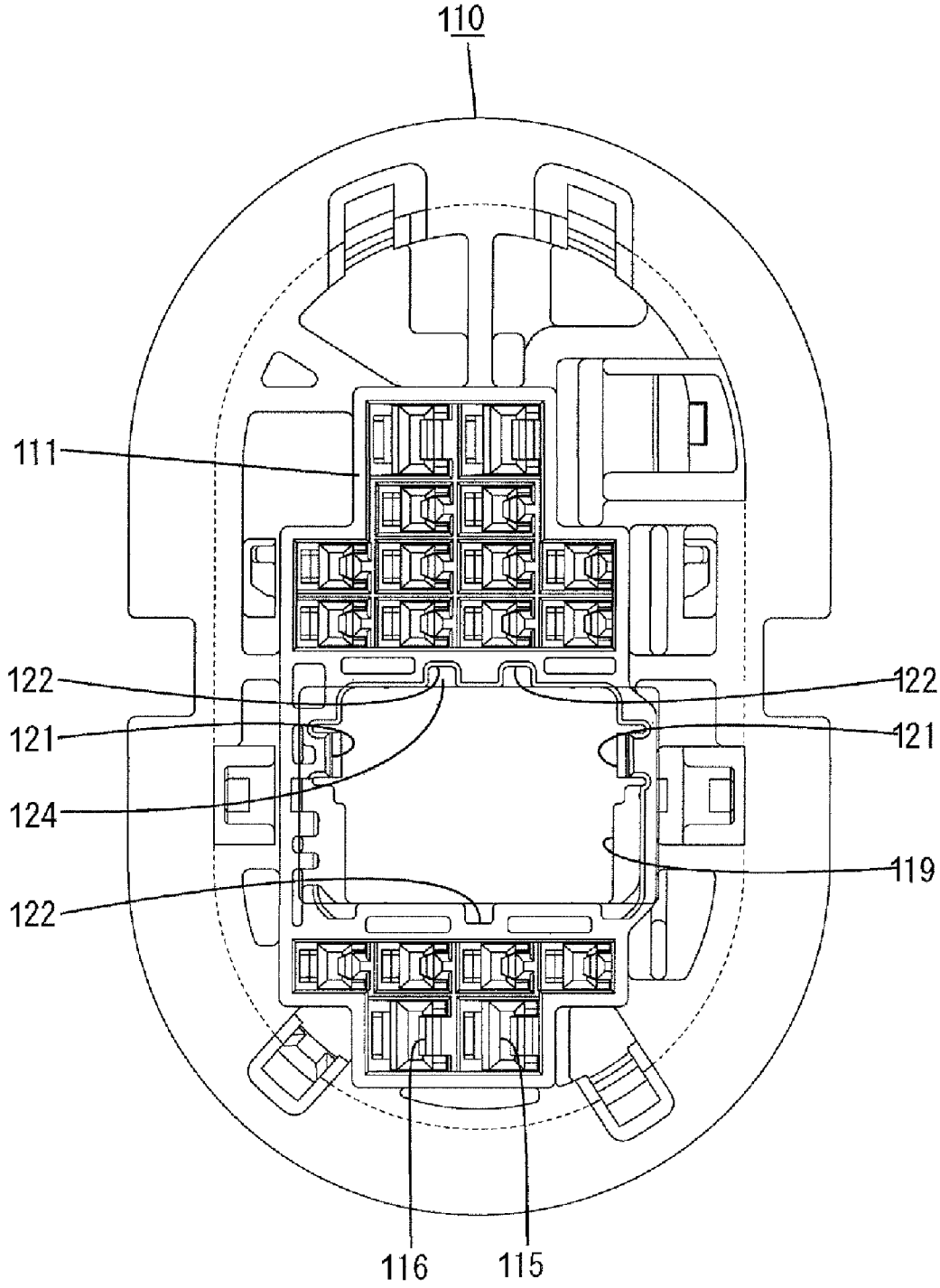
FIG. 10 is a rear view of a housing.

As shown in FIGS. 8 and 10, one chamber 119 is formed in an intermediate part of the housing main body 111 in the height direction and penetrates the housing main body 111 in forward and backward directions FBD. The chamber 119 is located right behind the assembled position of the moving plate 160. Additionally, the chamber 119 has a cross-sectional shape corresponding to the auxiliary housing 140 and is used to assemble the auxiliary housing 140. Two retaining portions 121 are formed in the chamber 119. The retaining portions 119 are formed in opposite inner side surfaces of the chamber 119 facing one another in the width direction. Further, receiving grooves 122 are formed in the inner surfaces of the chamber 119. The receiving grooves 122 have a rectangular cross-sectional shape with rounded corners. Two receiving grooves 122 are formed in the ceiling surface of the chamber 119 and one is formed in the inner bottom surface. The receiving grooves 122 on the ceiling of the chamber 119 are positioned in a rotationally asymmetric position with respect to the receiving groove 122 on the bottom surface thereof to prevent an improper mounting of the auxiliary housing 40 as described later. The two receiving grooves 122 in the ceiling are at opposite sides of the widthwise center and the one receiving groove 122 in the inner bottom surface is in the widthwise center. The rear ends of the receiving grooves 122 open in the rear surface of the housing main body 111, whereas the front ends of the receiving grooves 122 are slightly behind the front surface of the housing main body 111. A vertical closing wall 123 is between the front ends of the receiving grooves 122 and the front surface of the housing main body 111. The receiving grooves 122 extend substantially straight from the front ends thereof to the rear ends. The front ends of the receiving grooves 122 (rear surface of the closing wall 123) are substantially vertical and parallel with the front surface of the housing main body 111 and serve as front-stops 124 where the auxiliary housing 140 rests after reaching the proper assembled position.

Figure 11:
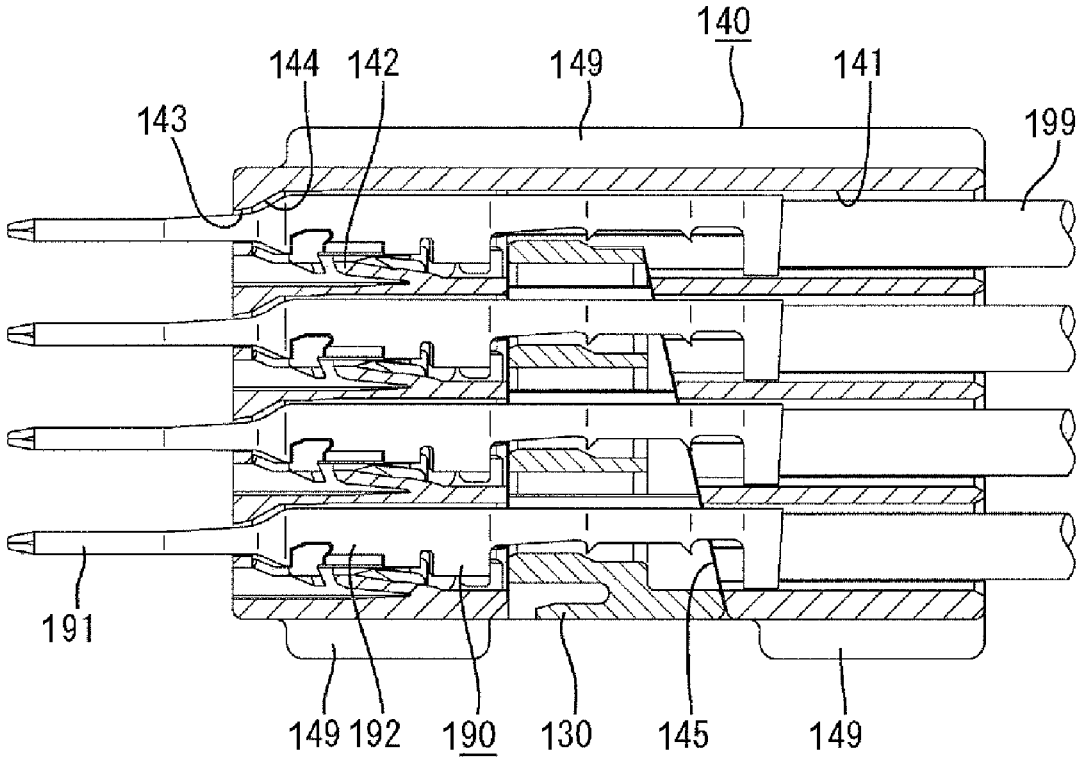
FIG. 11 is a side view in section of the auxiliary housing accommodating tab-shaped terminals.
Figure 12:
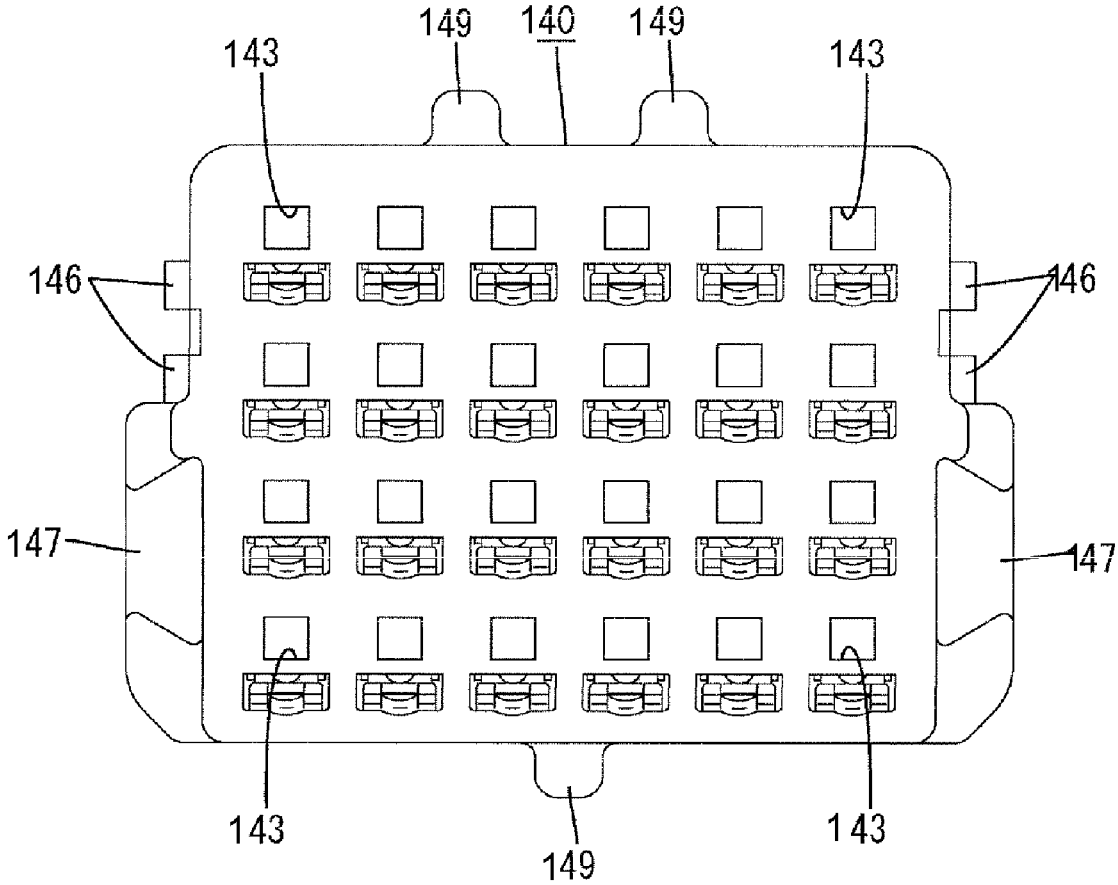
FIG. 12 is a front view of the auxiliary housing.

As shown in FIGS. 11 and 12, the auxiliary housing 140 is a substantially rectangular block that can be inserted into the chamber 119 of the housing main body 111 from behind. Cavities 141 penetrate the auxiliary housing 140 in forward and backward directions FBD for accommodating the terminals 190 connected with ends of wires 199. Resiliently deformable locks 142 are formed on the inner walls of the cavities 141 for retaining the terminals 190 and insertion holes 143 are formed in the front walls of the cavities 141 for receiving the tabs 191 of the terminals 190. Slanted front-stop surfaces 144 are located at least partly around the insertion holes 143 for limiting forward movement of the terminals 190. A retainer mount hole 145 is formed in a part of the auxiliary housing 140 behind the locks 142 and communicates with the cavities 141. A side-type retainer 130 can be inserted into the retainer mount hole 145 from below for locking the terminals 190. Thus, the terminals 190 are locked redundantly by the retainer 130 and the locks 142. Projections 146 are formed on opposite side surfaces of the auxiliary housing 140 for engaging the retaining portions 121 of the housing main body 111. The projections 146 are at positions slightly above the vertical center and close to the front end.

Bulges 147 bulge laterally out from the lower halves of the opposite side surfaces of the auxiliary housing 140, and parts of the opposite side surfaces of the retainer are exposed at openings 148 in the bulging portions 147. The front surface of the auxiliary housing 140 is a connection surface that contacts the mating female housing upon the proper connection, and the substantially rectangular insertion holes 143 for the tabs 191 are arrayed in height and width directions in the front surface. The tabs 191 of the terminals 190 that have been inserted properly into the cavities 141 project forward in an exposed manner from the front surface of the auxiliary housing 140 before the auxiliary housing 140 is assembled into the housing main body 111. On the other hand, the tabs 191 of the terminals 190 in the auxiliary housing 140 are at least partly covered in a protected manner by the receptacle 112 after the auxiliary housing 140 is assembled into the housing main body 111. More particularly, the leading ends of the tabs 191 of the terminals 190 pass partly through the positioning holes 163 of the moving plate 160 held at the advanced position immediately after the auxiliary housing 140 is assembled into the housing main body 111 and slightly project into the tube 162.

Ribs 149 extend in forward and backward directions FBD on the outer peripheral surface of the auxiliary housing 140. The ribs 149 align with the receiving grooves 122 if the auxiliary housing 140 is in a proper inserting posture relative to the chamber 119 to permit the auxiliary housing 140 to be assembled into the chamber 119. However, the ribs 149 do not align with the receiving grooves 122 if the auxiliary housing 140 is in an improper posture (e.g. upside-down) and interfere with the rear surface of the housing main body 111 to prevent the auxiliary housing 140 from being assembled into the chamber 119. Specifically, the ribs 149 have rectangular shapes with rounded corners to conform to the shapes of the receiving grooves 122. Front ends of the ribs 149 are retracted slightly from the front surface of the auxiliary housing 140 and rear ends of the ribs 149 are at the same position as the rear surface of the auxiliary housing 140. Two ribs 149 are offset to opposite sides of the widthwise center on the top surface of the auxiliary housing 140, and one rib 149 is at the widthwise center of the bottom surface of the auxiliary housing 140. The rib 149 on the bottom surface of the auxiliary housing 140 is interrupted at a position corresponding to the opening of the retainer mount hole 145, thereby being divided into front and rear parts before and after the retainer mount hole 145.

The auxiliary housing 140 can be inserted into the chamber 119 of the housing main body 111 from behind. The ribs 149 of the auxiliary housing 140 and the receiving grooves 122 of the housing main body 111 align if the auxiliary housing 140 is in the proper inserting posture. Thus, the auxiliary housing 140 can be inserted smoothly into the chamber 119. The ribs 149 slide on surfaces of the receiving grooves 122 in the inserting process to guide the insertion of the auxiliary housing 140. Front ends of the ribs 149 contact the front-stops 124 of the receiving grooves 122 as the insertion is completed to prevent further forward movement of the auxiliary housing 410. Further, the retaining portions 121 and the projections 46 engage in a detaching direction of the auxiliary housing 140 as the insertion is completed to prevent the auxiliary housing 140 from moving backward (see FIG. 6). Front surfaces of the auxiliary housing 140 and the housing main body 111 (back surface of the receptacle 112) substantially align in forward and backward directions FBD when the auxiliary housing 40 reaches the proper assembled position.

The lever 180 is positioned at the initial position and the moving plate 160 is positioned at the advanced position to prepare for connection. The female connector then is fit lightly into the receptacle 112 with the more cam pins pushed along the escaping grooves 113. As a result, the cam pins are fit into the respective cam followers 164 positioned on standby at the entrances of the cam grooves 183. Thus, the cam pins and the cam followers 164 are united and engaged with the cam grooves 183. The female housing of the female connector also is fit into the moving plate 160. The lever 180 then is rotated to the connection position. Accordingly, the moving plate 160 and the female connector are pulled together towards the back end of the receptacle 112 by the cam action exhibited by the engagement of the cam pins and the cam followers 64 with the cam grooves 183 and the two connectors reach a properly connected state. In this connecting process, the tabs 191 of the auxiliary housing 140 are restrained by the positioning holes 163 of the plate main body 161 and are kept in array, thereby being able to establish reliable electrical connection with female terminal fittings of the female connector. The lever 180 can be rotated in a reverse direction from the connection position to the initial position to separate the two connectors.

The ribs 149 and the receiving grooves 122 do not align if the auxiliary housing 140 is in the inverted posture, and hence insertion of the auxiliary housing 140 into the chamber 119 is prevented. At this time, the ribs 149 contact the rear surface of the housing main body 111 and a front area 151 of the housing main body 111 before the front ends of the ribs 149 is fit into the chamber 119 from behind to prevent loose movements while the tabs 191 are in the chamber 119 (see FIG. 9). In this state, the moving plate 160 is at the advanced position in the chamber 119 and the leading ends of the tabs 191 are distanced back from the rear surface of the plate main body 161 of the moving plate 160. Thus, there is no likelihood that the leading ends of the tabs 191 will contact with the rear surface of the plate main body 161. Even if the moving plate 160 is at the retracted position, the leading ends of the tabs 191 of the tab terminals 190 in the auxiliary housing 140 are still distanced from the rear surface of the plate main body 161. Therefore the tabs 191 are not likely to contact the rear surface of the plate main body 161.

Erroneous insertion of the auxiliary housing 140 into the housing main body 111 is prevented by the ribs 149 and the receiving grooves 122. Additionally, the leading ends of the tabs 191 of the terminals 190 in the auxiliary housing 140 are distanced back from the rear surface of the moving plate 160 when the ribs 149 interfere with the housing main body 111 during an erroneous assembling attempt. Thus, the tabs 91 exposed when the auxiliary housing 140 is alone will not be bent and deformed due to interference with the moving plate 160.

The front area 151 of the inverted auxiliary housing 140 is fit partly in the chamber 119 when the ribs 149 interfere with the rear surface of the housing main body 111 to prevent the ribs 149 of the auxiliary housing 140 from being forcibly inserted into the chamber 119 and to prevent more reliably the erroneous assembling of the auxiliary housing 140.

Stops 124 are defined at the front ends of the receiving grooves 122 to prevent the auxiliary housing 140 from moving any further forward. Thus, the construction of the housing main body 111 is simplified as compared to the case where front-stops are provided separately.

The tabs 191 are smaller than the tabs 190A, 190B, and hence are broken more easily by an impact. However, the tabs 191 are protected by the moving plate 160 to prevent such breakage. In this case, there is a little need to protect the larger tabs 190A, 190B, and no moving plates corresponding to these larger tabs are provided. Therefore, the moving plate 160 can be made smaller and can have a lower cost.

The invention is not limited to the above described and illustrated embodiment. For example, the following embodiments are also embraced by the technical scope of the present invention as defined by the claims.

Male terminal fittings need not be mounted into the frame.

The moving plate may be formed to have a main portion dimensioned to cover the entire opening of the receptacle of the frame.

The number and arrangement of the inverted insertion preventing portions can be varied.

It is sufficient to provide the chamber in a part of the frame. For example, the chamber may be provided in an upper or lower side of the frame.

The invention is applicable to connectors with or without an operable member to assist or perform the connection with a mating connector.

The front-stop may be provided at parts of the auxiliary housing other than at the inverted insertion preventing portions.

Converse to the second embodiment, the auxiliary housing may be formed with the receiving grooves and the housing main body may have the ribs.

Plural auxiliary-housing accommodating chambers may be formed in the housing main body, and the housing may be able to receive a plurality of auxiliary housings. In this case, the housing main body may not be formed with cavities.

The lever may be dispensed with.

The shapes, numbers and arrangements of the ribs and the receiving grooves are arbitrary provided that the erroneous assembling of the auxiliary housing can be prevented.

What is claimed is:

1. A connector, comprising:

a housing main body with opposite front and rear ends, at least one chamber extending into the rear end of the housing main body and at least one receptacle extending into the front end of the housing main body, the chamber and the receptacle communicating with one another;

at least one auxiliary housing insertable into the chamber of the housing main body from the rear end of the housing main body when the auxiliary housing is in a proper selected orientation relative to the chamber, the auxiliary housing having terminal fittings projecting in an exposed manner from a front end of the auxiliary housing and into the receptacle of the housing main body;

a moving plate mounted in the receptacle and movable back and forth between a position before the front end of the auxiliary housing and a position closer to the front end of the auxiliary housing, the moving plate having positioning holes for receiving portions of the terminal fitting disposed in the receptacle when the auxiliary housing is mounted in the proper orientation in the chamber and when the moving plate is in the position closer to the front end of the auxiliary housing; and at least one inverted insertion preventing portion formed on the auxiliary housing for contacting a rear opening edge of the chamber and preventing further forward movement of the auxiliary housing if the auxiliary housing is inserted into the chamber in an improper posture, a front end of the inverted insertion preventing portion being retracted from the front end of the auxiliary housing, and front ends of the terminal fittings and a rear end of the moving plate being distanced from each other when the inverted insertion preventing portion contacts the rear opening edge of the chamber.

2. The connector of claim 1, wherein the chamber is formed with at least one front-stop for contacting the inverted insertion preventing portion and preventing further forward movement of the auxiliary housing when the auxiliary housing is inserted into the chamber in a proper inserting posture.

3. The connector of claim 1, wherein the terminal fitting is a small terminal fitting, the connector further comprising at least one large terminal fitting larger than the small terminal fittings and arranged to project into the receptacle.

4. The connector of claim 3, wherein the moving plate is mounted into a part of the receptacle corresponding to the auxiliary housing and allows only the small terminal fittings mounted in the auxiliary housing to be passed therethrough.

5. A connector, comprising:

a housing main body having opposite front and rear ends, at least one chamber penetrating into the rear end of the housing main body in forward and backward directions, a forwardly open receptacle extending into the front end of the housing main body and communicating with the chamber;

at least one auxiliary housing insertable into the chamber from the rear end of the housing main body;

at least one terminal accommodated in the auxiliary housing and having a projecting portion projecting forward from the auxiliary housing and into the receptacle of the housing main body;

a moving plate mounted to the receptacle for aligning the projecting portion of the terminal while allowing the projecting portion to pass therethrough; and at least one rib formed on one of the auxiliary housing and the housing main body and at least one groove formed on the other of the auxiliary housing and the housing main body, the groove being disposed and configured to receive the rib upon inserting the auxiliary housing into the housing main body in a proper inserting posture, the rib being offset from the receiving groove if the auxiliary housing is in an improper posture for interfering with a wall surface of the other of the auxiliary housing and the housing main body to prevent insertion of the auxiliary housing into the housing main body, the projecting portion of the terminal being distanced backward from the moving plate while the rib and the other of the auxiliary housing and the housing main body interfere with each other.

6. The connector of claim 5, wherein the receptacle is a tube continuous with a front surface of the housing main body.

7. The connector of claim 5, wherein the receiving groove is formed in an inner surface of the chamber of the housing main body, and the rib is provided on an outer surface of the auxiliary housing.

8. The connector of claim 7, wherein the rib has a front end retracted from the front surface of the auxiliary housing.

9. The connector of claim 8, wherein an area of the auxiliary housing before the front end of the rib is fit into the chamber when the rib interferes with the surface of the housing main body if the auxiliary housing is in the improper posture.

10. The connector of claim 9, wherein a front end of the receiving groove defines as a front-stop for contacting the rib to prevent the auxiliary housing from moving farther forward when the auxiliary housing reaches a proper assembled position.

11. The connector of claim 5, wherein at least one tab having a size larger than the projecting portion of the terminal projects into the receptacle, the moving plate being mounted into a part of the receptacle corresponding to the auxiliary housing and allows only the projecting portion of the terminal mounted in the auxiliary housing to be passed therethrough.

* * * * *